United States Patent [19]

Wirth

[11] 4,129,924

[45] Dec. 19, 1978

[54] APPARATUS FOR SEPARATING CARD STRIPS DURING CARDING OF FIBROUS MATERIALS

[75] Inventor: Walter Wirth, Gausebrok, Fed. Rep. of Germany

[73] Assignee: Hergeth KG Maschinenfabrik und Apparatebau, Dulmen, Fed. Rep. of Germany

[21] Appl. No.: 823,690

[22] Filed: Aug. 11, 1977

Related U.S. Application Data

[63] Continuation of Ser. No. 632,791, Nov. 17, 1975, abandoned.

[30] Foreign Application Priority Data

Dec. 18, 1974 [DE] Fed. Rep. of Germany ..... 2459781

[51] Int. Cl.[2] ..... D01G 15/76

[52] U.S. Cl. ..... 19/99; 19/107; 19/109

[58] Field of Search ..... 19/107, 108, 109, 98, 19/99, 100, 102, 104

[56] References Cited

U.S. PATENT DOCUMENTS

| | | | |
|---|---|---|---|
| 1,071,035 | 8/1913 | Fauquet | 19/109 |
| 1,311,293 | 7/1919 | Schaefer | 19/109 |
| 1,936,548 | 11/1933 | Brooks | 19/108 X |
| 2,823,423 | 2/1958 | Suzuki | 19/109 |
| 2,937,411 | 5/1960 | Riehl et al. | 19/100 X |
| 3,402,432 | 9/1968 | Kalwaites | 19/104 |

FOREIGN PATENT DOCUMENTS

| | | | |
|---|---|---|---|
| 74197 | 4/1894 | Fed. Rep. of Germany | 19/107 |
| 85205 | 2/1896 | Fed. Rep. of Germany | 19/107 |
| 168028 | 3/1906 | Fed. Rep. of Germany | 19/100 |
| 582614 | 10/1924 | France | 19/100 |
| 32783 | 10/1970 | Japan | 19/107 |
| 465754 | 5/1937 | United Kingdom | 19/102 |

OTHER PUBLICATIONS

Saco-Lowell Shops Cotton Machinery (p. 209), First Edition, 1920.

*Primary Examiner*—Dorsey Newton
*Attorney, Agent, or Firm*—Diller, Ramik & Wight

[57] ABSTRACT

This disclosure relates to apparatus for separating card strips, such as fiber neps, fiber adhesions, short fibers, foreign particles, waste fibers and the like from fibrous material during a carding operation in which a rotating carding cylinder has means for carrying fibrous material therewith, a strips roller adjacent the carding cylinder defining therewith a gap through which the fibrous material is carried by the carding machine, and the strips roller including means for forming carding strips from the fibrous material which are subsequently removed therefrom.

6 Claims, 6 Drawing Figures

APPARATUS FOR SEPARATING CARD STRIPS DURING CARDING OF FIBROUS MATERIALS

This is a continuation of now abandoned application Ser. No. 632,791 filed Nov. 17, 1975 entitled APPARATUS FOR SEPARATING CARD STRIPS DURING CARDING OF FIBROUS MATERIALS.

The present invention is directed to an apparatus for separating fiber neps, fiber adhesions and foreign particles, known as card strips, as well as short fibers and waste fibers from fibrous material during the carding thereof.

Conventional carding machines loosen and disentangle fiber bundles or fibrous material in flock form into individual fibers, first orienting the fibers in the longitudinal direction and laying them parallel, and as far as possible separating any so-called card strips present, such as fiber neps, fiber adhesions, foreign particles and short fibers. Either sliver is formed as a first web-like product, which can be further processed into yarn by means of various spinning processes, or the oriented fibers remain in fleece form (even in subsequent processes) for the production of materials in the non-woven textile sector.

In order to fulfill these various functions in carding natural and synthetic fibers and mixtures thereof two different carding systems are conventionally employed. These systems substantially involve principles of the conventional roller card and the revolving flat card. In the field of short staple fibers the roller card is used in the non-woven sector for producing non-woven textiles, and the revolving flat card is used in the spinning sector for producing yarns. The reason for this is that in the manufacture of fleeces, along with the working width, the mixing and fiber orientation in the longitudinal and transverse directions is of importance in obtaining optimum quality of the end product. However, for yarn manufacture the prime importance is placed upon longitudinally oriented parallel fibers and purity of the card sliver.

The separation of neps, fiber adhesions, foreign particles and short fibers with flat card strips by means of moving card elements is known and is made possible only in the so-called revolving flat card. For this reason only the revolving flat card (single card or tandem card) is used for carding cotton. It is also known that impurities are also partly removed by rigid cleaning elements, such as licker-in and drum-grid, and separate coarse impurities are removed by moving grid elements on the licker-in.

Conventional devices are also provided for throwing heavier impurities by centrifugal force through a cleaning slot in the cover plate of the drum directly across from the doffer into a collecting trough. Neps or fiber adhesions are, however, not separated by this device.

Since the introduction of synthetic fibers into cotton processing and spinning more and more synthetic fibers have been processed on revolving flat cards. It has become apparent that the throughput of a revolving flat card and the degree of parallelizing of the fibers is markedly exceeded by a card with stationary flat card segments as a result of the larger enclosed card surface.

In the carding of snythetic fiber batches which have a higher number of neps and fiber adhesions than normal, or in the processing of mixtures and natural snythetic fibers (such as 67% polyester and 33% cotton) a disadvantage of a card with stationary carding segments has proved to be that the relatively lightweight impurities in the fiber material are not removed as with the revolving flat card. Neps and adhesions and foreign particles in a cotton mixture are in fact partially reduced in size and loosened or separated by a grid on the licker-in and cylinder, yet a residue in the card sliver which impairs the quality of the yarn, particularly when spinning into fine yarns of Nm 40 (tex 25) upwards.

It is therefore a primary object of this invention to provide in cards which have either stationary card segments or working rollers and cleaner or stripper rollers or a combination of both roller and flat card systems a device to enable an increased degree of separation of impurities in the fiber material including neps, fiber adhesions, etc. which are so-called card strips.

Thus, in accordance with the present invention an apparatus is provided for producing card strips including a strips roller constructed as a conventional card roller located in a carding position relative to a carding cylinder and cooperating therewith to produce the card strips with means for removing the card strips from the strips roller.

The strips roller or rollers are normally in a fiber-free condition but during the loosening of the fibrous material by preceeding carding means become filled with nepped or adhered fibers which adhere to the wire, pins, or spikes of the card clothing of the strips roller and the latter are removed therefrom along with foreign particles such as waste fibers and contaminants. Thus there remains only a very insignificant proportion of impurities in the eventual product which are conveyed from the carding cylinder to the doffing device. The strips roller or rollers have a semi-rigid card clothing or clothing covered with an all-steel saw-tooth wire. As the strips roller is arranged in a carding position relative to the carding cylinder an effective carding operation is also performed simultaneously with the removal of the card strips. Also the strips roller or rollers are advantageously rotated at a lower rotary speed than that of the card or carding cylinder.

In further accordance with this invention there is provided a stripper plate associated with the strips roller by means of which there is a regulation of the proportion of the strips produced in relationship to the throughput of the fibrous material through the carding machine. The stripper plate is preferably adjustable relative to a gap between the strips roller and the carding cylinder.

In further accordance with this invention means are provided for removing the strips by means of suction which preferably includes a suction nozzle extending the length of the strips roller. Alternatively, a traveling nozzle may be employed to remove the strips. The strips may also be removed from the strips roller by an oscillating doffer or chopper with the released card strips dropping into a suction trough.

The arrangement of the strips roller or rollers relative to the carding cylinder of the carding machine may vary according to a number of different requirements. Thus, the strips rollers may be arranged together in pairs or singularly either at the front, medially of and/or at the end of carding segments or elements which are outboard but immediately adjacent a periphery of the carding cylinder. The arrangement of the strips rollers in pairs immediately adjacent each other is extremely efficient in removing all impurities from the fibrous material, but in many cases one strips roller is sufficient in order to achieve a good cleaning effect. The tandem arrangement of the strips rollers is preferred for mixtures of natural and snythetic fibers, particularly snythetic/cotton mixtures. The number of strips rollers provided per carding cylinder and their working position relative to the carding cylinder to a large extent determines the resultant degree of cleaning of the fleece of fibrous material in the carding machine. In suitable cases carding elements and carding segments may be totally avoided and the strips rollers used both for the removal of card strips and for carding purposes.

The strips roller or rollers may revolve in either the opposite direction of rotation of the carding cylinder or in the same direction.

With the above and other objects in view that will hereinafter appear, the nature of the invention will be more clearly understood by reference to the following detailed description, the appended claimed subject matter, and the several views illustrated in the accompanying drawings.

IN THE DRAWINGS

Figure 1:
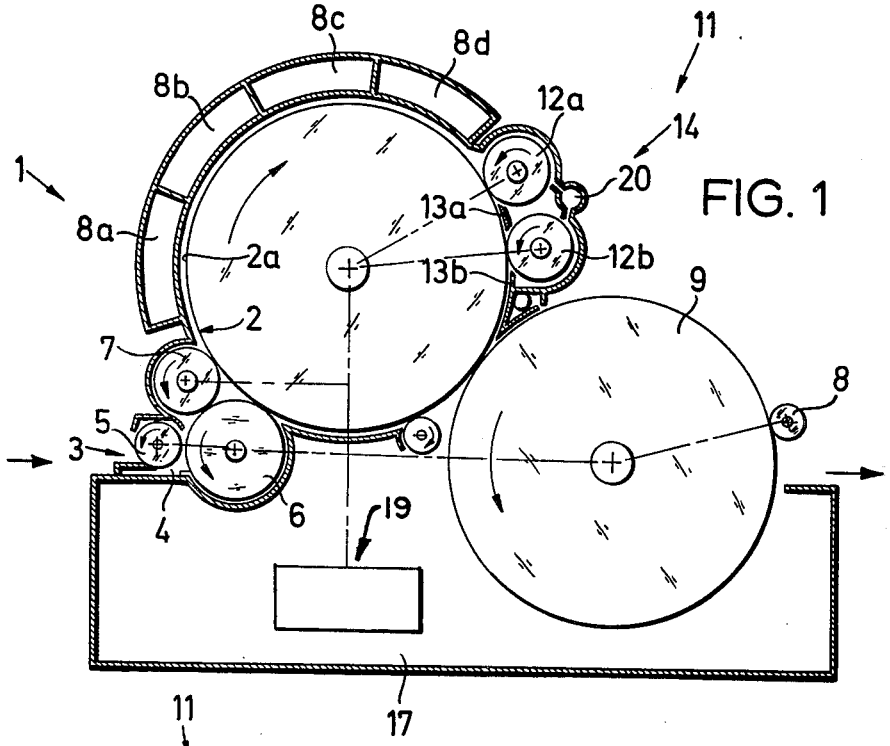
FIG. 1 is a side elevational view partially in cross-section of a carding machine constructed in accordance with this invention, and illustrates a pair of strips rollers adjacent one another at a discharge end of the carding machine.

Reference is first made to FIG. 1 of the drawings illustrating a carding machine or apparatus 1 having a carding cylinder 2 including conventional cylinder clothing 2*a*. The carding machine 1 includes an intake end portion 3 consisting of a trough plate 4 and an intake roller 5. Fibrous material introduced into the inlet 3 is transferred by the intake roller 5 to a licker-in end roller 6 and from the latter the material is transferred to the carding cylinder 2 in a relatively irregular distribution and is initially worked by a worker roller 7. The roller 6 fulfills the function of a stripper or cleaner roller. Thereafter, conventional carding segments 8*a* through 8*d* conventionally operate on the fibrous material as it is carried by the clothing 2*a* of the carding cylinder 2 between the segments 8*a*, 8*b* toward subsequent removal from the carding cylinder 2 by means of a doffing roller 9. The nap removal from the doffing roller 9 is effected by means of a roller discharge 8 or by a double doffer or chopper instead of the roller discharge with the nap being distributed to two belts by means of separating strips at the doffer or by suction or compressed-air nozzles. The removal of card strips and like impurities is effected by means generally designated by the reference numeral 11 formed by successive strips rollers 12*a*, 12*b* with which are associated respective stripper plates 13*a*, 13*b*. Means generally designated by the reference numeral 14 includes a vacuum manifold 20 for pneumatically withdrawing the card strips and other impurities from the peripheral surfaces of the strips rollers 12*a*, 12*b*. The machine 1 includes a housing 17 having suitable drive means, gearing, etc. schematically illustrated in both FIGS. 1 and 2 and bearing the reference numeral 19 to impart driving rotation to the rolls or rollers 2, 5, 6, 7, 8, 9, 12*a*, 12*b*, and other rollers (unnumbered) associated with the carding machine 1.

Figure 2:
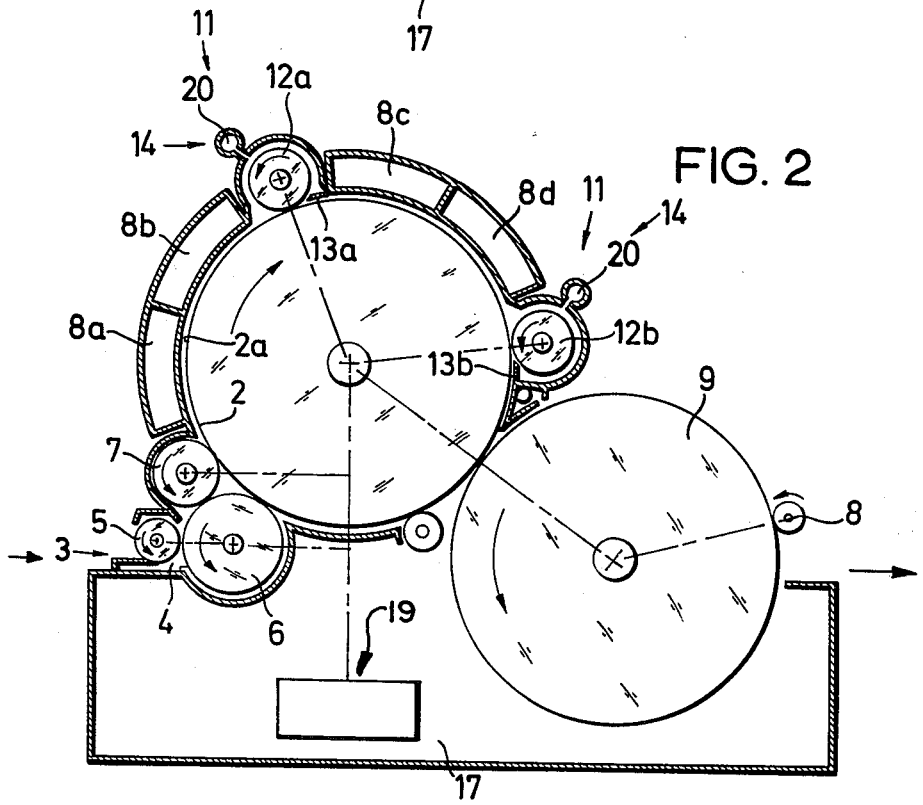
FIG. 2 is a view similar to FIG. 1 and illustrates another carding machine in which a pair of strips rollers are disposed in spaced relationship to each other with carding elements or segments disposed therebetween.

The machine of FIG. 2 bears like reference numerals and essentially corresponds to the machine 1 of FIG. 1 just described except for the location or working position of the strips rollers 12*a*, 12*b* and the means 11, 14 associated therewith. In the machine of FIG. 2 the strips roller 12*a* and the stripper plate 13*a* associated therewith are located between the carding elements 8*b*, 8*c*, along with the suction manifold 20. The remaining strips roller 12*b* with its associated stripper plate 13*b* and its suction manifold 20 is mounted beyond the carding elements 8*c*, 8*d* in the direction of rotation of the carding cylinder 2 and above the doffing roller 9. It is, of course, also possible to provide a strips roller or rollers above the worker roller 7 in advance of the carding segment or element 8*a*. Dependent upon the circumstances and the dimensions of the carding cylinder 2 the number of strips rollers and their working position relative to the carding cylinder 2 may be varied with the optimum arrangements being those shown in FIGS. 1 and 2.

Figure 3:
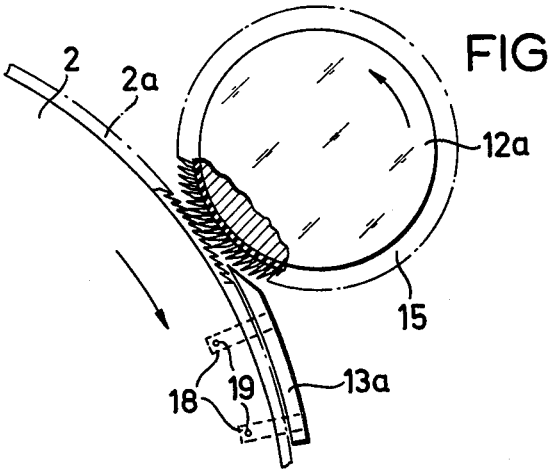
FIGS. 3 and 4 are diagrammatic side elevational views partially in cross-section illustrating two different constructions of the strips rollers and the manner in which the same rotate in the same direction as the associated carding cylinder.

Reference is now made to FIG. 3 of the drawings which illustrates the construction of the strips roller rollers 12*a*, as a relatively rigid cylinder encased by semirigid card clothing 15 preferably formed by a reinforced card fillet with a rubber covering which may advantageously be covered with flat steel wire or any other wire. In the embodiment shown in FIG. 4 the strips roller 12*a* has an all-steel saw-tooth wire clothing 16.

Figure 4:
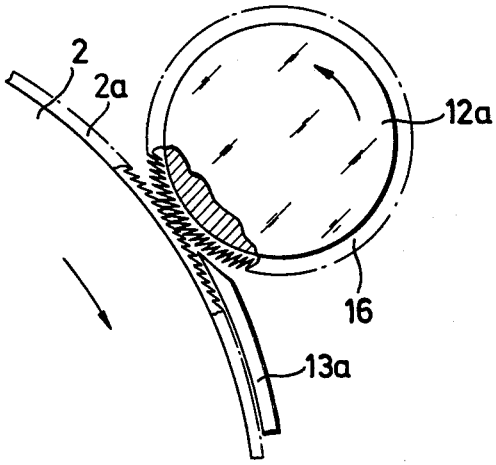

The strips rollers in both FIGS. 3 and 4 are arranged relative to the carding cylinder 2 in a carding position with the relative rotational directions of the strips roller 12*a* being the same as that of the carding cylinder 2.

Figure 5:
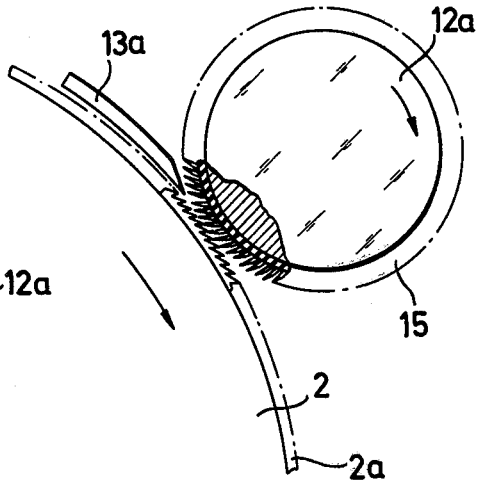
FIGS. 5 and 6 are views similar to FIGS. 3 and 4 but illustrate the opposite relative rotation of the strips rollers and the associated carding cylinder.
Figure 6:
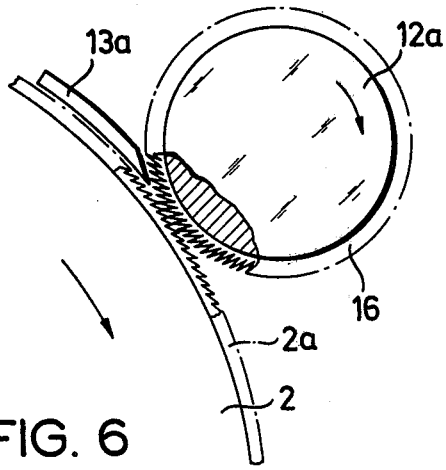

The embodiments of the invention illustrated in FIGS. 5 and 6 illustrate constructions of the rollers identical to that of FIGS. 3 and 4, respectively, except that the direction of rotation of the strips roller 12*a* is opposite to that of the carding cylinder 2.

The stripper plate 13*a* and the identically constructed stripper plate 13*b* (unillustrated in FIGS. 3 and 4) is preferably bolted or screwed to sides of the machine frame 17 by means of brackets 18 (FIG. 3) and set screws 19. The openings through which the set screws 19 pass may be elongated sufficiently to permit the stripper plates 13*a* to be located deeper into or further out of a gap (unnumbered) between the stripper rollers 12*a* and the carding cylinder 2, as well as being adjusted toward and away from the clothing 2*a* of the carding cylinder 2. The spacing of the stripper plate 13*a* from the cylinder clothing 2*a* of the carding cylinder 2 is advantageously set in the range of from about 0.3 to 0.8 mm, and from the clothing of the stripper rollers 12*a* in the range of from about 0.4 to 1.0 mm. The stripper plate 13*a* divides the fiber nap between the carding cylinder 2 and the strips rollers 12*a*. In this way the desired percentage of card strips may be set in order to achieve the necessary purity of the fibers in the card sliver or in the nap. Adjustment of the stripper plate 13*a* toward the strips rollers 12*a* increases the number of strips occurring and adjustment toward the carding cylinder 2 reduces the number of strips occurring. This effect results from the fact that the clothing which is best protected from losing its fiber filling by means of the closer set stripper or separator plate 13*a* receives the largest number during separation of the nap. The actual carding work is effected between the carding cylinder 2 and the strips rollers 12*a*, 12*b* the latter of which though not illustrated in FIGS. 3 and 4 is constructed identically to the strips roller 12*a* heretofore described and is located in the same direction as the strips roller 12*b* in FIGS. 3 and 4. The intensity of this carding work depends on the properties of the clothing, the spacing, and the relative speeds of the carding cylinder and strips rollers. The strips rollers take up predominantly nepped or adhered fibers which remain stuck by their ends on pins or wire of the clothing with foreign particles also being removed from the nap.

The diameter of the strips rollers 12*a*, 12*b* has an effect on the degree of cleaning. As the strips rollers diameter increases so does the size of the carding surface. Various roller diameters are possible and an optional economical roller diameter advantageously lies between about 170 mm and about 260 mm.

The strips rollers rotate at a relatively low speed. The peripheral speed of the strips rollers preferably lies in a range of about 4 to 40 cm per minute. Dependent upon the carding quality, however, this speed may be considerably higher. As the speed of the strips rollers 12*a*, 12*b* increases the filling of the clothing of the same diminishes slightly. This diminution, however, is proportionately less than the increase in speed so that the occurrence of strips increases in percentage in relation to the throughput amount. On the other hand, the purity of the card sliver or fleece does not decrease in the same proportion as the strips roller rotates more slowly and in this case loss of fibers with the strips is avoided. The relative and decisive speed for the carding and removal of impurities diverges so little in both the possible directions of rotation of the carding cylinder relative to the strips cylinders that no significant influence can be seen as regards the intensity of carding. It is, however, important that the strips rollers rotate in a direction opposite to that of the carding cylinder the strips rollers should be entirely free of fibers at the removal or doffing side. The result is that during discharge of strips toward the doffing side coarser impurities can be removed from the fibrous mass. The removal of strips from the strips roller is advantageously effected pneumatically by means of suction, as was heretofore noted, by means of the suction nozzle or manifold 20. This suction may be generated by a suction blower which is simultaneously used for removal of fiber dust from the carding machine. The suction nozzle may be located stationary in an axial direction over the entire length of the strips rollers 12*a*, 12*b*, but for more intensive suction and cleaning a traveling or oscillating nozzle may be alternatively used. The latter should have a relatively narrow air inlet slot so that as a result of the locally concentrated suction effect due to the high air speed the strips sitting on the pins or wire of the clothing are effectively removed with all impurities. Alternatively, in order to suck the strips from the strips rollers the release of the same may be effected by an oscillating chopper or doffer with the release strips then dropping into a suction trough for removal.

The stripper plate or plates 13*a*, 13*b* are arranged in such a way that their direction is toward the release point of the stripper rollers 12*a*, 12*b* from the carding cylinder 2. For this reason the stripper plate 13*a* of FIGS. 5 and 6 is located in each case above the strips roller 12*a* with the pointed end directed towards the nip formed between the strips roller 12*a* and the carding cylinder 2.

While preferred forms and arrangement of parts have been shown in illustrating the invention, it is to be clearly understood that various changes in details and arrangement of parts may be made without departing from the scope and spirit of this disclosure.

I claim:

1. Apparatus for removing card strips, such as fiber naps, fiber adhesions, short fibers, foreign particles, waste fibers and the like from fibrous material during a carding operation comprising a carding cylinder carrying carding means in opposed relationship to carding means disposed about the exterior of said carding cylinder, means for rotating said carding cylinder whereby said carding means cooperatively perform a carding operation upon fibrous material conveyed through the apparatus by said rotating carding cylinder, means for directly removing card strips from the fibrous material carried by the rotating carding cylinder independent of said carding means but during the performance of said carding operation by said carding means, said removing means including a strips roller disposed adjacent said carding cylinder and defining therewith a gap through which said fibrous material is carried by said rotating carding cylinder, means for rotating said strips roller, vacuum means for removing card strips from said strips roller, stripper plate means contiguous said gap for dividing the fibrous material into two portions from only one portion of which is removed the card strips by said strips roller, means for adjusting the position of said stripper plate means to selectively alter the amount of fibrous material in each of said two portions whereby a select precentage of card strips are removed from said fibrous material depending upon the amount of fibrous material in said only one portion, said removing means includes another strips roller disposed adjacent said first-mentioned strips roller and adjacent said carding cylinder, said another strips roller and carding cylinder define another gap through which said fibrous material is carried by said rotating carding cylinder, means for rotating said another strips roller, said vacuum means being operative to remove card strips from said another strips roller, and said stripper plate means being disposed between said first-mentioned and another strips roller.

2. The apparatus as defined in claim 1 including another stripper plate means contiguous said another gap for dividing the fibrous material into another two portions from only one portion of which is removed the card strips by said another strips roller.

3. The apparatus as defined in claim 1 wherein said adjusting means is operative to selectively adjust the position of said stripper plate means relatively radially with respect to said carding cylinder.

4. The apparatus as defined in claim 3 including further adjusting means operative selectively to adjust the position of said another stripper plate means relatively radially with respect to said carrying cylinder.

5. Apparatus for removing card strips which are impurities such as fiber neps, fiber adhesions, short fibers, foreign particles, waste fibers and the like from fibrous material during a carding operation comprising in combination:

a carding cylinder provided with carding clothing about its periphery and means for rotating said carding cylinder;

feed means for feeding fibrous material to one region of said carding cylinder, said fibrous material being carried by said carding cylinder;

doffing means for removing card sliver substantially free of neps and waste and the like from another region of said carding cylinder;

carding means disposed adjacent said carding cylinder and between said feed means and said doffing means, said carding means cooperating with said carding cylinder to perform a carding operation upon the fibrous material fed to and carried by said carding cylinder;

strips roller means mounted for rotation between said carding means and said doffing means and downstream of said carding means for removing card strips from across the entire periphery of said carding clothing and which constitute a minor fraction only of the material fed to said carding cylinder, means for rotating said strips roller means at a speed of rotation less than the speed of rotation of said carding cylinder, and adjustable stripper plate means in cooperation with said strips roller means for controlling the thickness of the card strips being removed from the fibrous web having been carded whereby the minor fraction of material constituting the card strips is fiber neps, fiber adhesions, short fibers, foreign particles, waste fiber and the like in the substantial absence of usable fiber, and means adjacent said strips roller means for removing without further recycling substantially all of the material constituting said card strips from said strips roller means.

6. The apparatus as defined in claim 5 including means for selectively adjusting the position of said stripper plate means radially with respect to said carding cylinder.

* * * * *